United States Patent [19]

Dosch et al.

[11] 4,185,288

[45] Jan. 22, 1980

[54] MOBILE RADAR TOWER

[75] Inventors: Thomas J. Dosch, Orchard Park; Rawley McCoy, Bronxville; Theodore W. Steele, Williamsville, all of N.Y.

[73] Assignee: Sierra Research Corporation, Buffalo, N.Y.

[21] Appl. No.: 875,848

[22] Filed: Feb. 7, 1978

[51] Int. Cl.[2] ..... H01Q 3/08

[52] U.S. Cl. ..... 343/765; 343/713; 343/882; 343/880

[58] Field of Search ..... 343/765, 766, 882, 883, 343/890, 901, 902, 713, 880; 52/116–118

[56] References Cited

U.S. PATENT DOCUMENTS

| | | | |
|---|---|---|---|
| 3,286,265 | 11/1966 | Clemence et al. | 343/765 |
| 3,377,595 | 4/1968 | Carr et al. | 343/713 |

FOREIGN PATENT DOCUMENTS

| | | | |
|---|---|---|---|
| 266868 | 11/1966 | U.S.S.R. | 343/713 |

*Primary Examiner*—David K. Moore
*Attorney, Agent, or Firm*—Dowell & Dowell

[57] ABSTRACT

A mobile tower supporting a radar antenna system including a drive system and position resolvers, the antenna system being mounted at the top of a cylindrical telescopable mast which is hinge mounted on a tripod base and is erected to a vertical operative position by an hydraulic ram which also retracts the mast to a substantially horizontal position for transport or servicing by personnel standing on a pallet supported by the base, the tower further including tilt and twist monitors having outputs coupled to a computer together with the outputs of the position resolvers to provide a corrected readout of azimuth and elevation angles of tracked targets.

12 Claims, 10 Drawing Figures

MOBILE RADAR TOWER

FIELD OF INVENTION

This invention relates to mobile radar towers, and more particularly relates to an improved ground supported radar tower which is mobile not only in the sense that it is easily transported from one location to another, but also mobile in the sense that its radar supporting mast is quickly and easily erected to a substantially vertical operational position or retracted to a substantially horizontal position wherein it can be manually partially reassembled in compact configuration for transport.

BACKGROUND AND PRIOR ART

When providing a supporting structure for a ground based radar it is highly desirable and often necessary to elevate the radar well above ground level to raise it clear of ground clutter obstructions of a local nature such as buildings, trees, hills, vehicles, fences, etc. This is particularly true of a mobile radar unit because there is the expectation that the unit will be moved from one operational location to another as dictated by the exigencies of the situation. The use of a mast which can raise the radar antenna provides savings in the time required to set up the radar and render it operational, since such elevation reduces or eliminates the need to clear the land of local obstructions.

In uses wherein the radar is required to achieve a high degree of angular precision and wherein its antenna is elevated on a tower structure, it has been necessary using prior art techniques to provide a massive tower structure to obtain platform rigidity. In an effort to reduce the weight of such towers, guy wires have often been substituted for massive construction, but experience has shown that guyed structures can only be used where low angular precision is required because of the difficulty in providing high tension in the wires while maintaining the plural wire tensions uniform.

Moreover, conventional support towers are subject to distorting forces which introduce angular errors, such forces including windage, thermal expansion and contraction of non-symmetrical cross-sections, and unequal heating in various parts of the tower structure due to non-uniform exposure to sunlight. Unequal temperature effects produce rotational movements at the top of the tower with respect to the ground, generally about all three axes, i.e. rotation about azimuth, and tilt about level and cross-level. These rotational movements produce errors in the radar determinations of the positions of targets being tracked. The magnitude of errors in level and cross-level due to solar and wind effects on ordinary open-truss structural steel towers set in concrete foundations range in the vicinity of 1.0 to 3.0 milliradians for towers whose height is comparable to the presently disclosed tower, i.e. about 25 feet. When compared with the magnitude of errors in level and cross-level introduced by a precision radar itself, which range in the vicinity of 0.1 to 0.25 milliradian, it will be seen that the errors introduced by an open-truss tower are about ten times greater. Moreover, the towers described above are not suitable for mobile purposes.

Furthermore, when a fixed tower is used, its size and weight and windage responses are further increased by the necessity of providing access to the antenna for repair and maintenance, since such a tower must be fitted with stairs or ladders, and with work platforms and railings located at the top of the tower.

When prior art towers are used in support of military operations their greater size and weight is particularly detrimental because it decreases their mobility and therefore increases their vulnerability. Often a high degree of mobility with short set-up and tear-down times is the best means of protection against enemy observation and enemy fire. This is especially true during intervals between missions while the radar is not in actual use, whereupon the radar antenna can be retracted so that it is no longer exposed above the terrain where it is in full view and even serves to locate other vulnerable equipment as well as personnel. The conventional tower suffers from the further disadvantage of exposing radar repairmen to enemy fire when they must climb the tower to service or repair the antenna.

THE INVENTION

The present invention provides a mobile radar tower which overcomes the limitations of the conventional fixed radar tower. It comprises a tripod supporting a base structure about which a cylindrical mast is horizontally pivoted so that it can be selectively retracted or erected to occupy either a horizontal position or a raised operational position by actuating an hydraulic cylinder. The mast supports a radar antenna and pedestal drive inside a Radome and includes error sensors which are coupled to a computer which determines orientation of the antenna, compensated for errors in the mast position. The mast base supports a pallet on which workers can stand while servicing the equipment when the mast is retracted to its horizontal position. The tripod and the mast can be reassembled manually into any one of several configurations, one of which is a tranport configuration occupying a minimum of space. The mast includes multiple sections that can be telescoped to different heights, and these sections are made symmetrical in cross-section to minimize windage and thermally induced distortions.

It is the object of this invention to provide a mobile radar tower which is much lighter in weight than conventional towers, is easily transported, quickly and easily erected or retracted, and can be easily reassembled in compact form for transport. It can be moved between erected and retracted positions by one man in less than two minutes, thereby making it protectable between missions without loss of its usefulness when needed. When retracted, the radar antenna is in a convenient position to be serviced or repaired by personnel standing on the ground or on the pallet, thereby obviating need to climb the tower or to increase its weight or decrease its symmetry by the inclusion of stairs, ladders or work platforms with rails at the top of the tower. The tower is so constructed that when erected the mast is returned nearly exactly to the same azimuth rotational position each time, after being retracted, using special keyways and keys for locating the mast with respect to its supporting base, the hinge pivot being relatively loose.

It is the further object of this invention to provide a symmetrical mast structure which is not subject to large distortions, taken in combination with electrical means for detecting and compensating such errors as are introduced for example by wind and sun loading distortion effects, and by possible shifting or settling of the tripod legs on the earth. Said error detecting and compensating means are provided to take out such errors as occur despite efforts to minimize them by making the mast and Radome structures as nearly symmetrical as possible about the vertical. Moreover, a twist monitor is provided which includes a lower member that sits on the ground beneath the tripod and is stationary with respect to the mast when in raised position, and further includes electrical sensors on the bottom of the mast which engage this stationary member and deliver signals to the computer indicating any twist in azimuth orientation. Other distortions which are detected and compensated occur about two orthogonal axes which lie in a horizontal plane and are measured as levelling errors of the antenna support platform at the top of the mast. Bubble levels are used by an operator to quickly set the approximate level by manually adjusting jacks located at earth engaging soil pads carried on the tripod legs. Thereafter biaxial tilt monitors are used to detect any residual or newly occurring errors, and signals from these tilt monitors are introduced into the computer for compensating the radar-determined angles to a target. These error compensations are most useful when tracking targets which are well elevated above ground, since atmospheric and multipath errors are usually dominant when tracking objects at low elevation angles.

Other objects and advantages of this invention will become apparent during the following discussion of the illustrative embodiment shown in the drawings.

THE DRAWINGS

DESCRIPTION OF PREFERRED EMBODIMENT

Figures 1, 10:
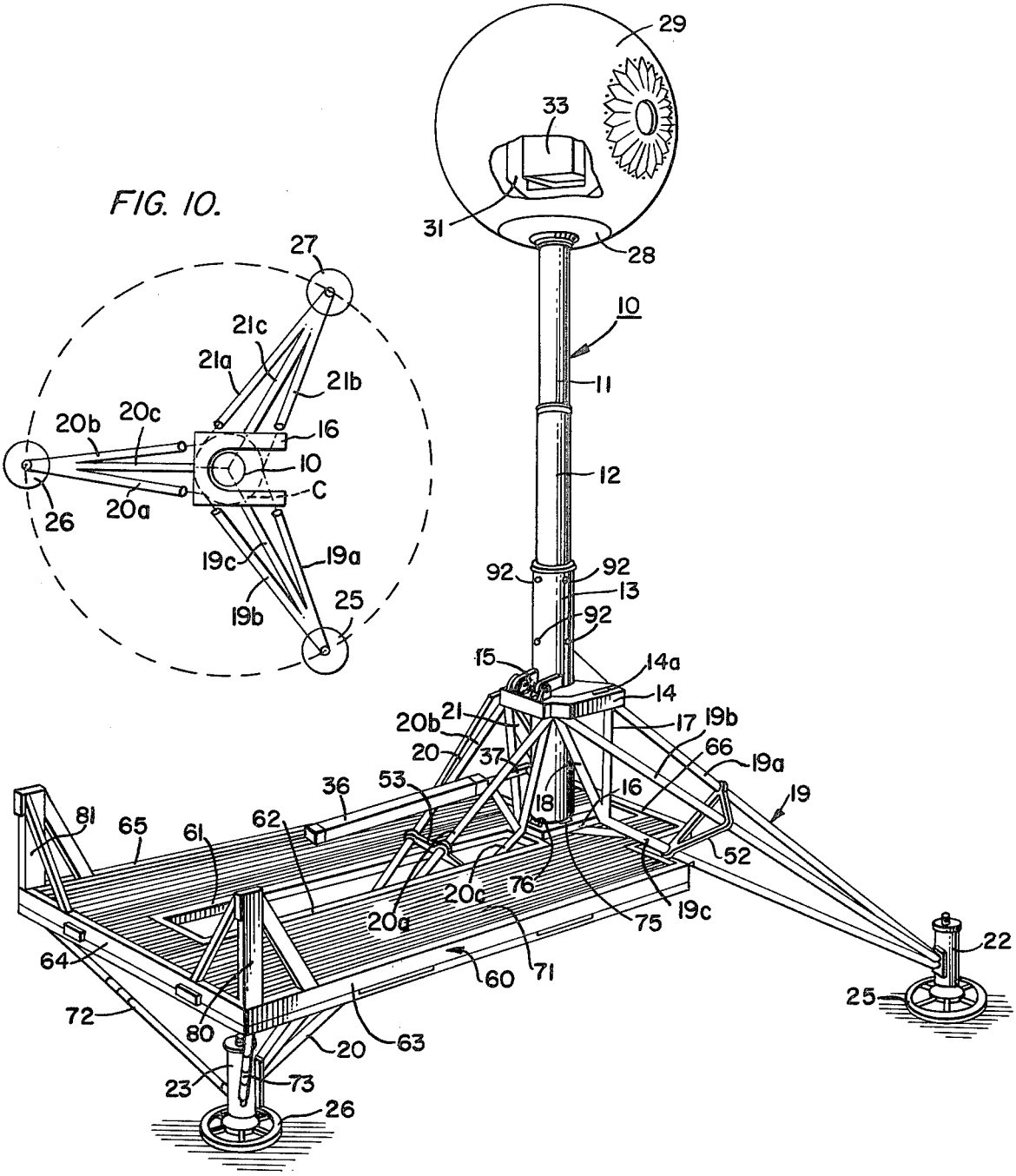
FIG. 1 is a perspective view showing a mobile radar tower according to the present invention in operational position and with the mast and Radome containing the antenna erected.
FIG. 10 is a schematic view looking down on the tripod from a plane just below the upper plate 14.
Figure 2:
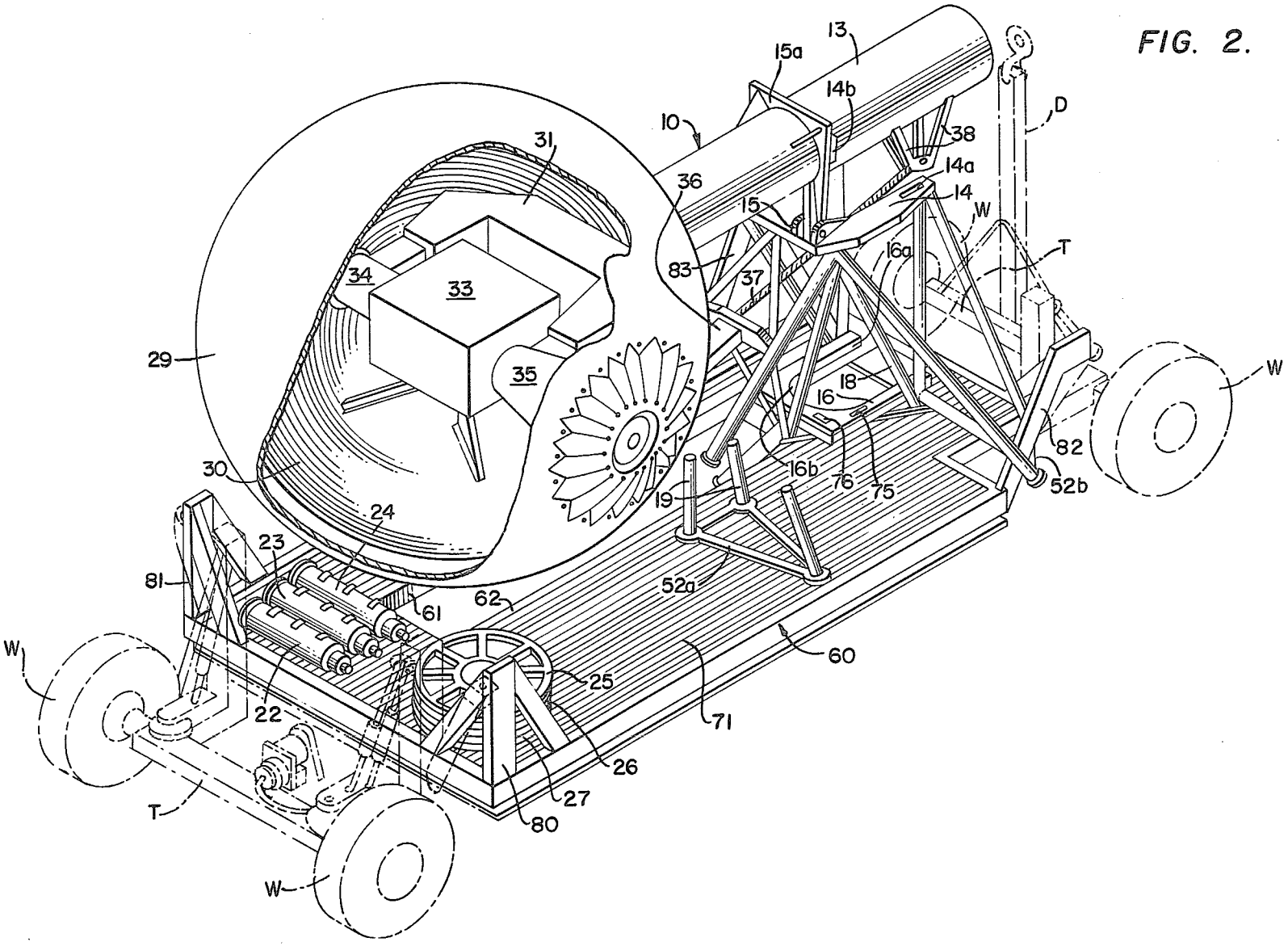
FIG. 2 is a perspective view showing the mobile radar tower with the mast retracted and lying substantially horizontal in transport configuration with standard military transport wheel units attached to both ends so that the unit can be towed behind a vehicle.

The figures of the drawing show a preferred embodiment of the invention. FIGS. 1 and 2 show a mobile radar tower unit having a tubular mast 10 having three telescoping sections 11, 12, and 13, the lowermost section being supported on a plate 14 by means of a hinge fitting 15. The upper plate 14 together with a lower plate 16 comprise the base structure of the mast, and this structure also includes suitable struts 17 and 18 which hold the plates 14 and 15 in mutually spaced relationship. The base structure including the upper and lower plates 14 and 16 is supported directly on the ground by three tripod leg assemblies 19, 20 and 21, only a small bit of the leg member 21 being visible in FIG. 1. These leg assemblies are made in the form of tubular trusses which are separable at triangular joint members such as the members 52 and 53. Each leg of the tripod support has an adjustable jack, such as the jacks 22, 23 and 24, two of which are visible in FIG. 1. Each of the jacks, in turn, rests on a soil pad through a ball and socket joint in a manner which is well known per se, the soil pads being labelled 25, 26 and 27.

Figures 3, 9:
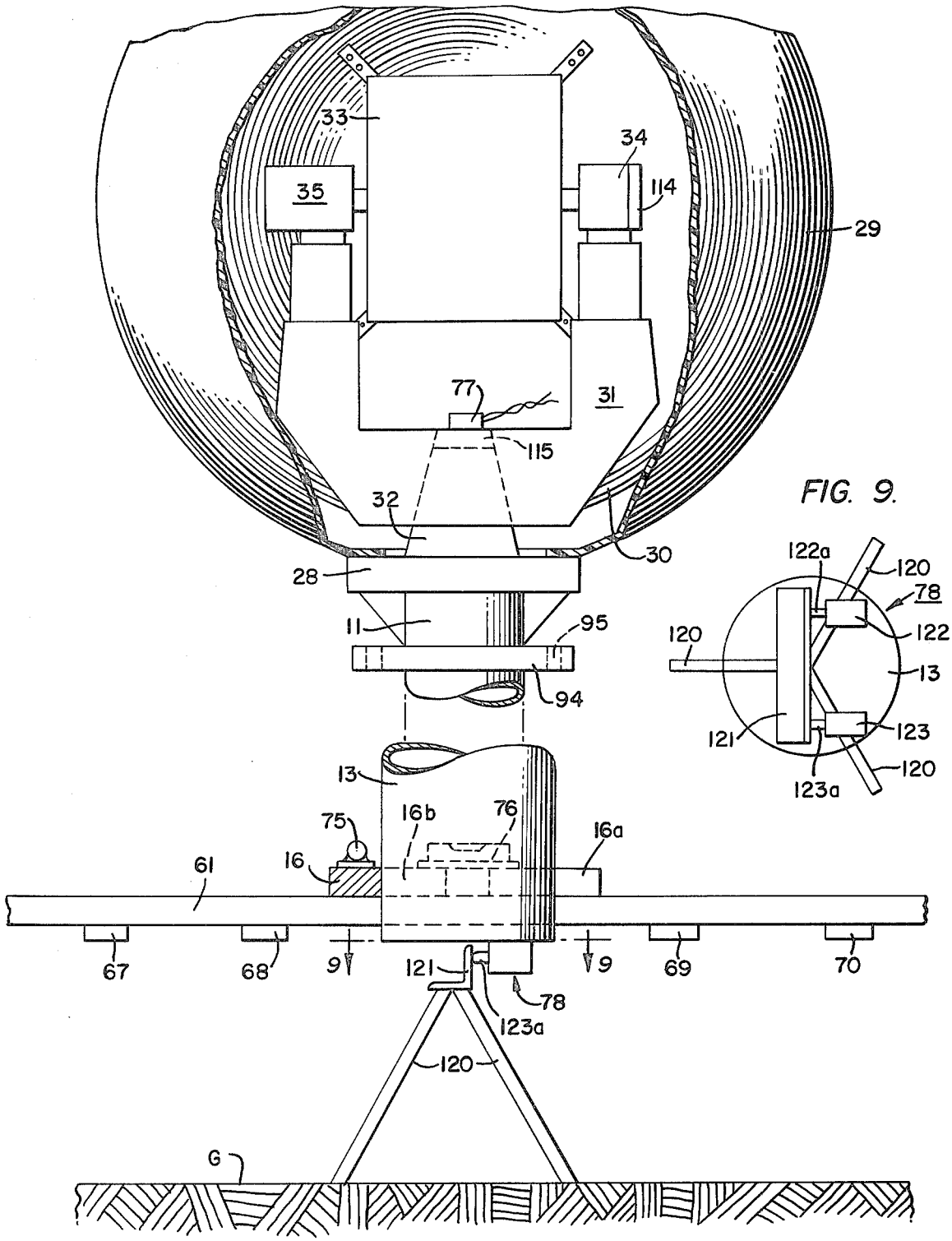
FIG. 3 is an enlarged elevation view partly in section and showing the upper and lower portions of the mast and connected components in greater detail.
FIG. 9 is a sectional view taken along line 9—9 of FIG. 3.

At the top of the mast, there is a platform 28 which supports a fiberglass Radome 29 housing a radar antenna dish 30, see FIG. 3, which is supported on a U-shaped pedestal 31 which is in turn supported on an azimuth servo drive unit 32 which rests on the platform 28 at the top of the upper mast section 11. The antenna 30 is supported on a box 33 at its center, which box contains suitable transmission line coupling hardware. The U-shaped pedestal in turn supports a pair of bearing assemblies including a right-hand bearing 34 and a left-hand assembly 35 which comprises the elevation servo drive assembly.

The telescoping mast assembly 10 is pivotable about the hinge 15 from a fully erected vertical position as shown in FIG. 1 to a retracted position fifteen degrees below horizontal as shown in FIG. 2. The erected vertical position shown in FIG. 1 is the operational position, whereas the horizontal retracted position as shown in FIG. 2 is a transport position as well as a convenient position in which maintenance operations can be performed, either on the radar antenna and drive assemblies or on the mast in order to change the length of its telescoped units, which is done manually.

Figure 7:
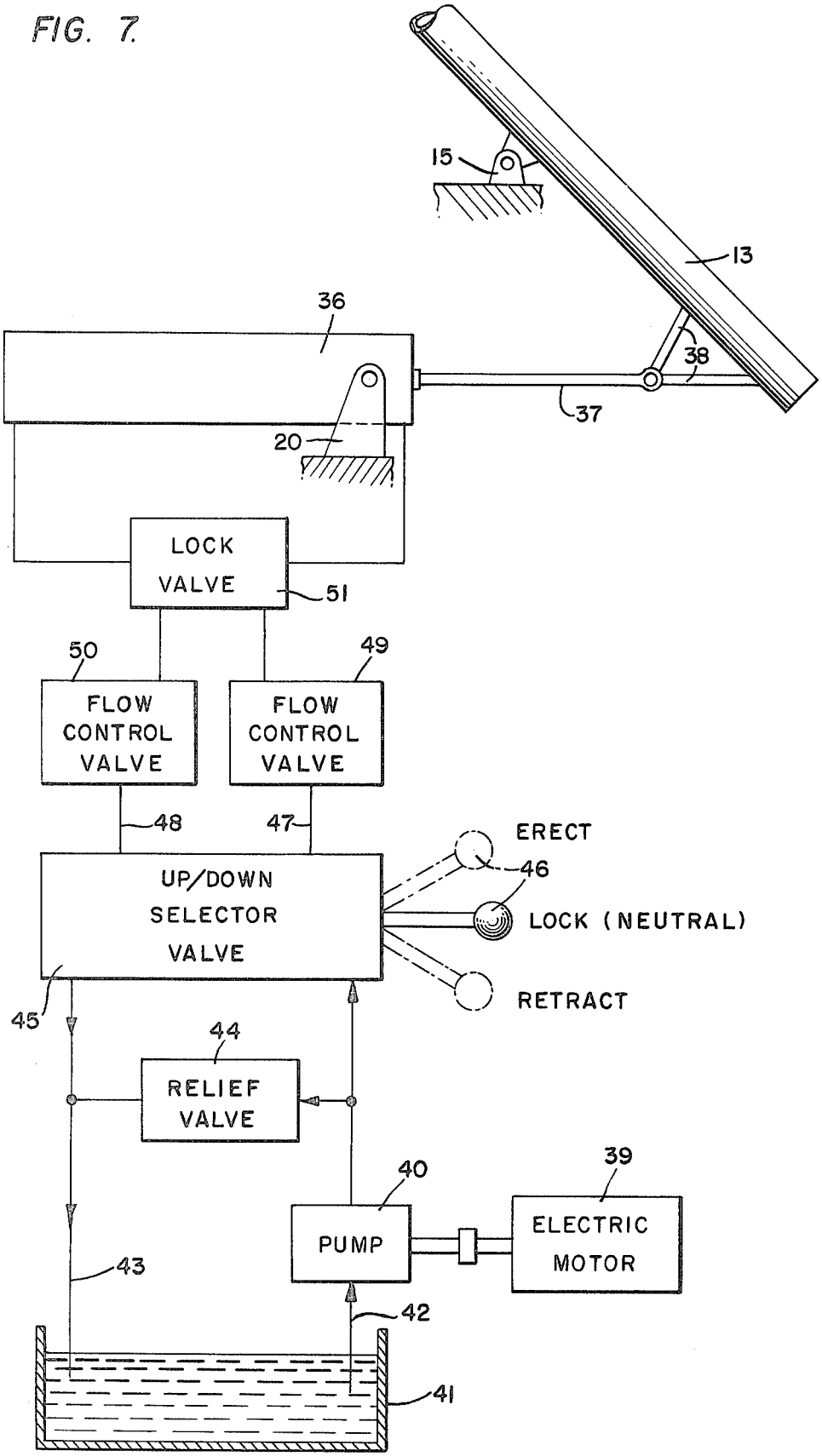
FIG. 7 is a diagram of an hydraulic circuit used to erect and retract the mast.

The mast is pivoted about the hinge 15 by an hydraulic cylinder 36 which can be seen in FIGS. 1 and 7, and is supported on the tripod leg assembly 20 by suitable trunnions located at the right-hand end of the cylinder nearest the mast. The cylinder has a piston rod 37 whose outer end is pivoted to a fixed triangular truss structure 38 welded to the lower section 13 of the mast as can be seen best in FIG. 7. Thus, the hydraulic cylinder pulls the mast into erected position about the hinge 15 when the piston rod is pulled into the cylinder, but lowers the mast to a substantially horizontal retracted position when the piston rod is extended as shown in FIG. 2.

FIG. 7 also shows an hydraulic circuit used to actuate the cylinder 36, the hydraulic circuit being powered by an electric motor 39 which drives an hydraulic pump 40 taking liquid from a reservoir 41 through a pipe 42 and returning hydraulic liquid to the reservoir 41 through the pipe 43. A relief valve 44 regulates the hydraulic operating pressure in a manner well known per se. Control of the mast position by controlling the position of the cylinder 36 is accomplished through a manually operated up-down valve 45 having a control arm 46 extending therefrom. The valve 45 is such that in the neutral position, the cylinder 36 is locked, whereas in the up-position hydraulic pressure to erect the mast is delivered through the pressure line 47 and flow control valve 49, whereas in the down-position of the control arm 46 the cylinder 36 is actuated through the pipe 48 and flow control valve 50 to extend the piston rod 37, thereby retracting the mast to the aforesaid position in which it is fifteen degrees below horizontal. Of course, the mast can be stopped in any position of tilt which is desired for servicing purposes. A lock valve 51 is provided in the main hydraulic lines to the cylinder 36 in order to prevent pressure from leaking undesirably between the two ends of the cylinder when the control lever 46 is in locked neutral position.

FIGS. 1 and 2 show a pallet assembly 60 which serves as a work platform for maintenance personnel and also as a pallet-type support during transport of the mobile radar tower unit. The pallet in the working embodiment as presently manufactured is 13 feet by 8 feet, and is made of welded aluminum parts. Its main structural elements comprise a pair of 8-inch I-beams 61 and 62 which run substantially the full length of the platform and define a central opening as shown in FIGS. 1 and 2 through which the leg assembly 20 extends downwardly. The pallet further includes a box section comprising members 63, 64, 65 and 66 around the outside of the pallet, and suitable supporting cross beams such as the beams 67, 68, 69 and 70, FIG. 3, are welded between the I-beams 61 through 66 in order to provide a rigid framework. The top of the pallet structure is covered with a prefabricated grating generally referred to by the reference numeral 71, this grating being suitable not only as a walking surface, but also being suitable to store the jacks 22, 23 and 24 and soil pads 25, 26 and 27 as shown in FIG. 2, and to support the outer portions of the tripod legs which can be separated from the inner portions of the tripod legs respectively at joint members 52 and 53, there being a similar joint member in the far leg which is not visible in FIG. 1. The outer portion of the tripod leg 19 is shown sitting on the grating 71 of the platform in FIG. 2, but part of the leg 19 is omitted from the drawing so as not to obscure the mast supporting members in the background. When the outer portions of the legs 19, 20 and 21 are mounted for transportation on the platform, they can be attached to the mast when in horizontal position and used to add further support thereto. It should be noted that the inner portions of the tripod legs 19, 20 and 21 are attached only to the base plates 14 and 16, but not to the pallet 60. When the mobile radar mast unit is set up as shown in FIG. 1, the mast base and the mast are completely supported by the tripod leg structure, and the pallet is merely suspended from the bottom plate 16 of the base structure. The left-end of the pallet as shown in FIG. 1 is supported on two auxiliary support struts 72 and 73 which are attached to the outer end of the tripod leg 20 in the vicinity of the jack 23.

The pallet 60 is provided with stanchions 80 and 81 at the left-end thereof as shown in FIGS. 1 and 2, and with stanchions 82 and 83 as shown at the right-end of FIG. 2, and these stanchions are used to interface with wheel modules at each end of the pallet. The modules being used are the standard military M-720 transporter as illustrated in FIG. 2, these transporters being referred to by the reference numeral T and providing wheels W in the four corners of the unit. When the unit is being towed using the drawbar D as shown in FIG. 2, the mast will be in the lowered position, and the jacks 22, 23, and 24 as well as the soil pads 25, 26 and 27 and other demountable components such as the outer ends of the tripod legs 19, 20 and 21 are then supported on the platform. Moreover, the mast is telescoped to minimal length. In the illustrative embodiment the pallet is shown supported on standard transporters at each end, which permits the assembly to be towed behind a truck or rolled into the cargo compartment of suitable aircraft. However, the load assembly may be transported without using wheeled mobilizers by loading the tower unit when in the transport configuration onto the bed of a truck or by using a lifting sling which will permit it to be air-lifted by helicopter.

Figure 6:
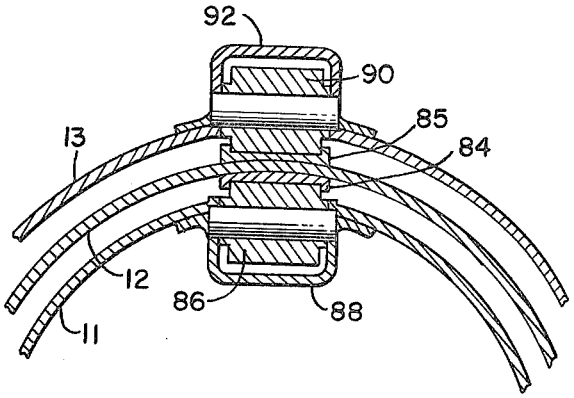
FIG. 6 is an enlarged fragmentary sectional view taken along line 6—6 of FIG. 4.
Figure 5:
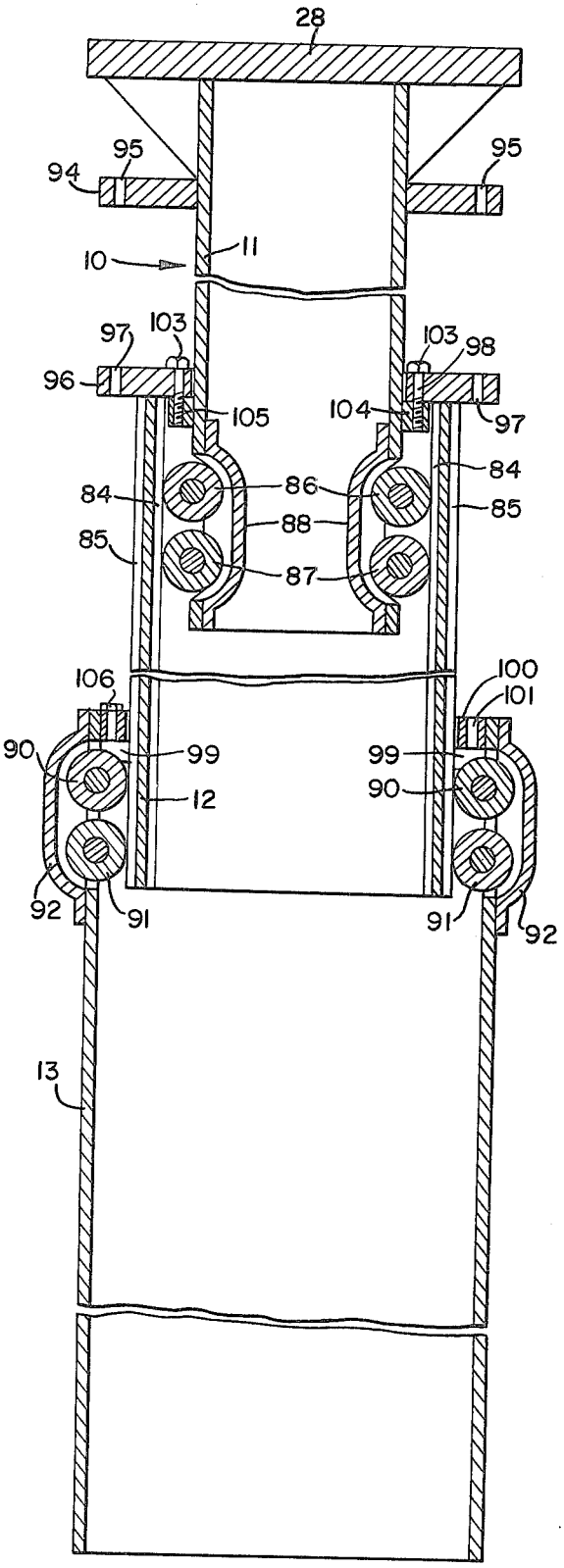
FIG. 5 is a longitudinal sectional view through the mast corresponding with the view shown in FIG. 4, but showing the mast telescoped out to extended position of all three sections.
Figure 4:
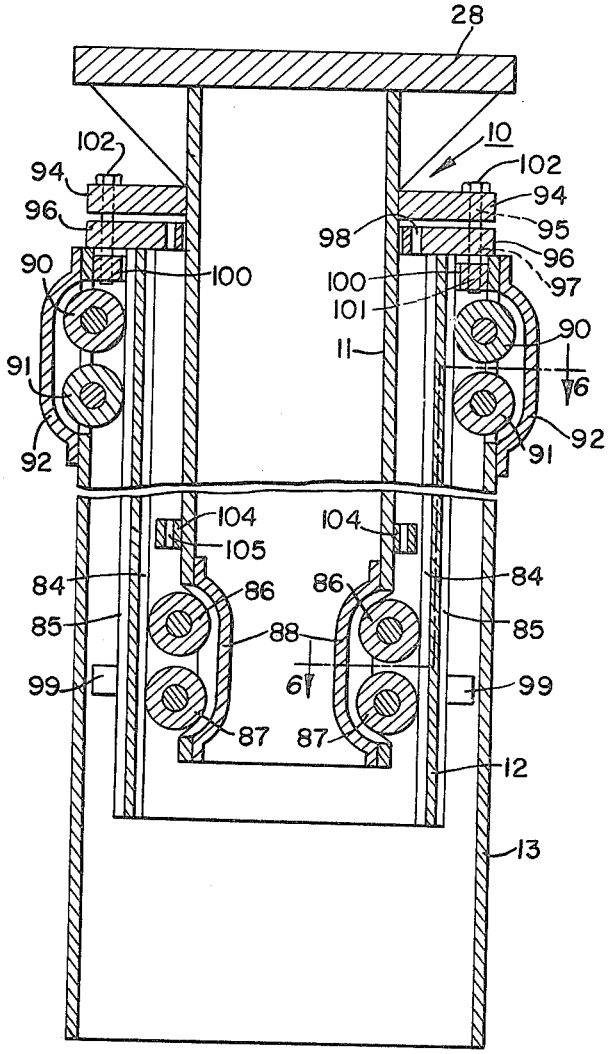
FIG. 4 is a cross-sectional view through all three sections of the mast showing the mast telescoped into shortened position.

Referring now to FIGS. 4, 5 and 6, it will be recalled that the mast 10 has three telescoping mast sections including an upper section 11, an intermediate section 12 and a lower section 13. The intermediate section 12 of the mast has two or more guidance tracks spaced apart around its periphery and extending longitudinally along the intermediate section 12, each pair of tracks including an inner track 84 and an outer track 85 which are secured to the mast section 12 in a manner not illustrated in the drawings, preferably by welding. The upper mast section 11 then carries a pair of longitudinal spaced rollers 86 and 87 which are located within a housing 88 which is mounted in a hole inside the upper mast section 11 and extends through the mast section so that the rollers 86 and 87 travel upon the inner track 84 as shown in FIG. 6. Thus, the upper mast section 11 is easily reciprocable with respect to the intermediate mast section 12.

Likewise, the lower mast section 13 supports two or more roller assemblies which are mounted outside thereof with two longitudinally spaced rollers 90 and 91 which are journaled in a housing 92 on the outside of the mast. Several of these units can be used in longitudinally spaced relationship along the length of the mast section as indicated at 92 in FIG. 1 in order to achieve better rolling guidance on the tracks 85 for the lower section of the mast. In this way, the intermediate mast section tracks 84 and 85 respectively support and guide the rollers which roll the upper mast section 11 and support and guide the rollers which roll the lower mast section 13 to provide essentially friction-free telescoping support of the three mast sections relative to each other. The housings 88 and 92 are preferably spot-welded in place on the tubular mast sections 11 and 13.

FIG. 4 shows the mast sections in shortened position, whereas the showing in FIG. 5 illustrates the mast sections in fully extended position. It will be noted that the upper section 11 of the mast carries an annular ring 94 which has an annular series of holes 95 therethrough. Moreover, the intermediate mast section 12 has an upper annular flange ring 96 with an annular series of holes 97 therethrough near the outer periphery of the flange ring and an additional annular series of holes 98 closer to the center of the flange ring. This flange ring 96 is fixed around the top of the intermediate mast section 12. There is another annular ring 99 which is fixed around the intermediate mast section 12 at a lower level. Finally, at the top of the lowermost mast section 13 there is an internal annular ring 100 which has an annular series of holes 101 extending therethrough.

The annular rings 94, 96, 99, and 100 are used to bolt the mast sections selectively in either extended or shortened axial positions as shown in FIGS. 4 and 5. For instance, in FIG. 4 the bolts 102 pass through the annular rings 94, 96, and 100 and bolt the mast sections in fully shortened position as shown also in FIG. 2. In this position, when the mast is erected to a vertical position, the mast height would be about 15 feet above the ground. FIG. 5 shows all three sections fully extended vertically. The bolts 103 hold the mast sections 11 and 12 telescoped axially apart as far as they will go. Moreover, the intermediate section 12 and the lower section 13 are also telescoped as far apart as they will go so that the annular ring 99 abuts the internal ring 100 and these two rings can be bolted together by bolts represented by the bolt head 106 shown in FIG. 5. Actually, as shown in FIGS. 4 and 5 the annular ring 99 is partly cut away in the vicinity of the track 85 so as to pass the rollers 90 and 91, and therefore, the bolts 106 should not be visible in FIGS. 4 and 5, but would lie in planes in front of and behind the plane of the drawing.

It should be further understood that it is not necessary that both telescoping sections be fully shortened or fully extended, because only one can be extended. If this is done, the height of the radar tower in the model being currently built would be raised from a shortened position in which the antenna is about 15 feet high to a partially extended position with only one mast section extended, in which case the mast would be 20 feet high. In the fully extended position the mast is 25 feet high.

For the purpose of orienting the mast in an approximately vertical position when it is erected, the lower tower base plate 16 is open at one end 16*a* as shown in FIGS. 2 and 3, so that when the mast is erected about the hinge 15, the lower portion of the bottom section 13 of the mast will enter the open end 16*a* of the plate 16 and be stopped by an arcuate saddle 16*b* as can be seen best in FIGS. 2 and 3. The upper plate 14 of the tower base structure as seen in FIGS. 1 and 2 includes multiple conical shaped keyways 14*a* which receive multiple similarly shaped projections 14*b* on the lower surface of the upper hinge plate 15*a*. Thus, when the upper hinge plate 15*a* is closed against the upper plate 14 of the tower base structure, the conical projection 14*b* comprising a key will extend into the keyway 14*a* and precisely locate the plate 15*a* with respect to the plate 14. In this manner, the position of the mast is accurately restorable each time it is erected from a retracted position. Moreover, the hinge 15 is made loose enough so as to permit final location of the position of the hinge plate 15*a* on the upper plate 14 to be determined by the keys 14*b* and the keyways 14*a*.

Figure 8:
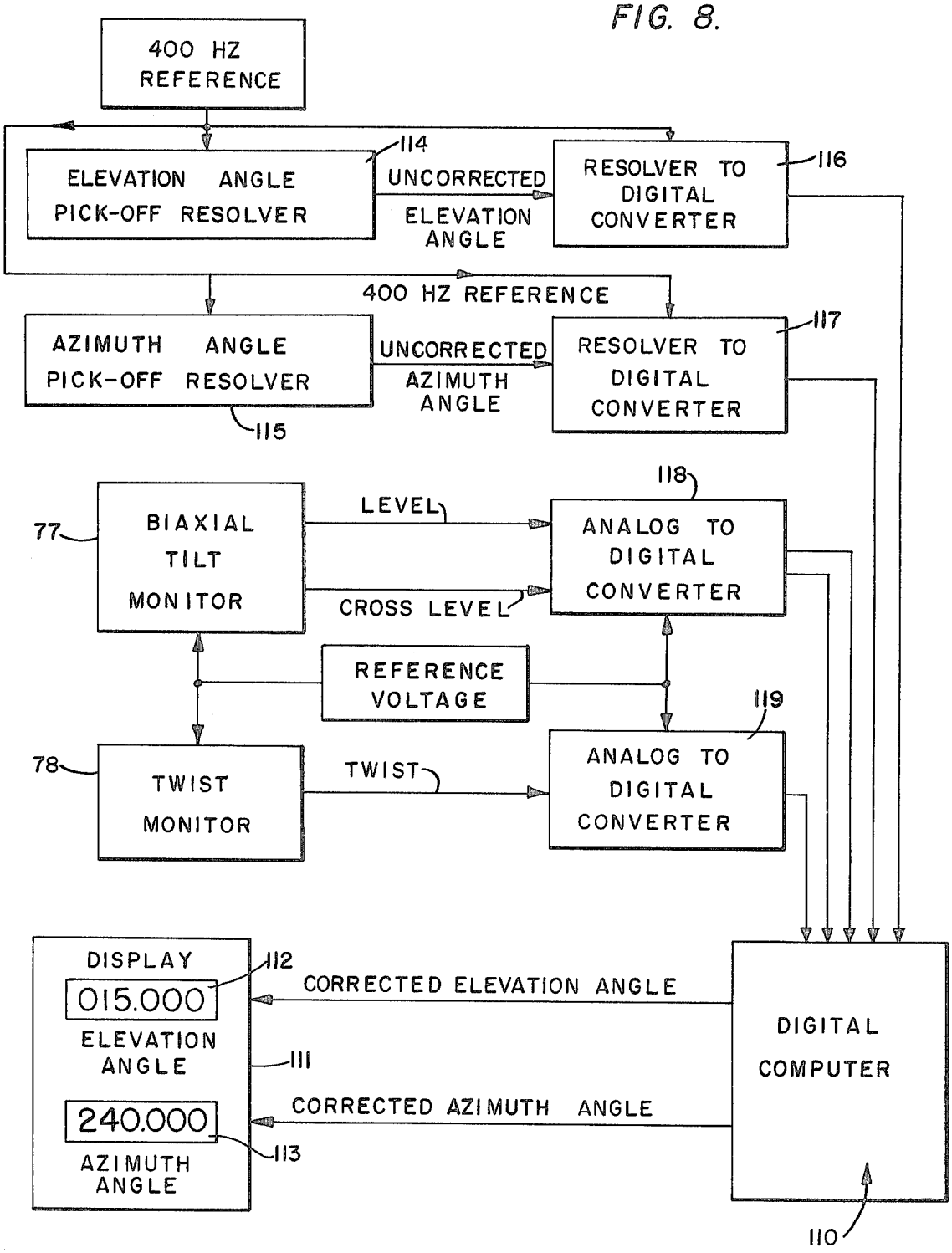
FIG. 8 is a block diagram of an electronic system for resolving and displaying corrected elevation and azimuth angles of the radar system.

When the mobile mast unit is initially being deployed for operation, the three jacks 22, 23 and 24 are adjusted so as to provide a good level position for the mast base structure and for the pallet 60. For this purpose, two orthogonally oriented bubble levels 75 and 76 are carried by the lower plate member 16 of the tower base structure, FIGS. 2 and 3. These bubble levels are conveniently located where they can be easily seen by men while adjusting the jacks in order to substantially level the tower unit. Such approximate levelling is adequate in the preferred embodiment of the invention because of the fact that electronic means, FIG. 8, are provided for removing any residual errors in levelling of the tower unit, and also for the purpose of compensating out any new errors which might be introduced by wind loading, sun loading, or shifting of the soil pads on the earth during use of the equipment. In cases where precision accuracy of the elevation and bearing angles is not required, the bubble levels would be adequate, and would not require electronic correction. This might be the case when tracking objects substantially at ground level where the errors introduced by multipath and by atmospheric effects exceed in magnitude normal levelling errors in the positioning of the tower.

Referring now to FIG. 8, a digital computer 110 delivers to a digital display 111 a corrected elevation angle for the antenna which appears in window 112, and a corrected azimuth angle for the antenna which appears in window 113. These angles are taken from a pair of standard resolvers 114 and 115 which are part of the standard radar antenna drive units, the elevation angle pickoff resolver 114 being located in the bearing mount 34, and the azimuth angle pickoff resolver 115 being located in the azimuth drive servo unit 32, all as shown in FIG. 3. The resolvers 114 and 115 deliver uncorrected elevation angle signals and uncorrected azimuth angle signals to resolver-to-digital converters 116 and 117 respectively which convert these angles to digital form and deliver them to the computer 110. In view of the fact that the base supporting structure for the mast may be somewhat tilted with respect to the horizontal plane, a tilt monitor 77 is provided in the antenna supporting yoke 31, the tilt monitor 77 having two analog outputs comprising voltages which represent tilt about two nominal horizontal axes. These outputs from the biaxial tilt monitor 77 are converted to digital form by an A/D converter 118 which then delivers these signals to the digital computer. These signals represent errors with respect to horizontal levelling of the tower base, and the computer uses them to correct the angles introduced into the computer from the resolvers and converters 114 and 115. Finally, in view of the fact that it is possible for the mast to be angularly displaced about its axis with respect to the ground, a twist monitor 78, FIG. 3, is provided below the mast. The twist monitor includes a tripod having legs 120 which sits directly on the ground. These legs support an elongated angle iron bar 121 which can be seen in FIG. 9 and which extends substantially across the base of the mast section 13, but spaced from it. In addition, the twist monitor includes two slide type potentiometers 122 and 123 which have plungers 122*a* and 123*a* which lean against the angle iron 121. When the unit is first placed upon the ground, the tripod is moved so that it partially depresses the plungers 122*a* and 123*a*, which are spring urged outwardly against the angle iron bar 121. Therefore, two differentially related analog signals can be taken from the potentiometers 122 and 123, and these signals vary in a push-pull manner so that if the mast twists with respect to the ground, one potentiometer output increases and the other potentiometer output decreases. The resultant of these two analog signals is delivered as an analog voltage to the A/D converter 119 which in turn delivers a digital correction to the computer 110 which corrects the azimuth angle coming from the resolver 115 and the converter 117. Thus, the azimuth position of the antenna pedestal is continuously monitored with respect to the ground beneath the antenna tower, since nothing else but the plungers touches the tripod supported angle iron 121.

The resolvers, resolver-to-digital converts, the tilt monitor, and the A/D converters are well known devices used in radar type systems and need not further be described because no novelty is claimed with regard to the nature of these units per se, and no novelty is claimed for the general idea of applying error signals to a digital computer which then corrects azimuth and elevational angles taken from antenna position resolvers. The structure of the twist monitor is believed to be novel.

This mobile radar tower has been especially designed to minimize azimuth error effects caused by sunlight shining on the mast, but a certain amount of tilting at the top of the mast can occur due to non-uniform sunlight heating effects. Virtual freedom from azimuth rotation at the top of the mast due to sunlight or windage effects is achieved by symmetry in construction of the mast about its own axis. Not only symmetrical geometry, but also careful selection of materials of which the mast is made tends to minimize twisting effects thereof due to illumination or windage. However, azimuth errors can still occur as a result of shifting of the soil beneath the soil pads 25, 26 and 27 on the main tripod support.

In addition special attention has been paid to the geometry of the structure of the rigid base and tripod legs which support the mast. By reference to FIGS. 1 and 10 it will be seen that each of the tripod legs 19, 20 and 21 comprises a welded aluminum tubing truss having two upper struts 19*a* and 19*b*, 20*a* and 20*b*, and 21*a* and 21*b*. Each truss further has a lower strut 19*c*, 20*c* and 21*c*. The lower struts are fixed to the lower base plate 16 in such locations that extensions of their axes intersect the center of the mast. The upper struts are fixed to the upper base plate 14 in pairs as shown in FIG. 10, and the axes of each pair intersect at three equally spaced points about an imaginary circle C whose center coincides with the center of the mast, although there are actually four points of connection to the upper plate 14 due to its horseshoe shape. This leg geometry transfers the load from the mast 10 to the ground through nine symmetrically placed struts with minimal bending moments in any of these members. As a result, the torsional, lateral and vertical stability of the tripod base structure is maximized while still conserving weight. This stability of the tripod base structure not only achieves satisfactory resistance to deflection of the tower, but also insures repeatability of the orientation of the mast when it is retracted and then erected again by the hydraulic ram 36.

The invention is not to be limited to the exact embodiment shown in the drawings, for obviously changes can be made therein within the scope of the following claims.

We claim:

1. A mobile tower for supporting a radar antenna system including an associated azimuth and elevation drive pedestal, and for selectively moving the antenna system between a substantially horizontal retracted position and an erected operational position which is restorable with a high degree of precision each time the antenna system is erected, comprising:

(a) a base including a central rigid portion and a tripod portion including three legs extending from the rigid portion and having adjustable height ground contacting pads, the central rigid portion of the base comprising an upper plate supporting a horizontally pivoting hinge and a lower plate spaced therebelow and including a saddle to receive and locate the lower end of the mast when in erected position;

(b) antenna system support means including a mast having an upper end supporting said antenna system, and the mast being fixed above its lower end to said hinge which includes a hinge plate connected to the mast and overlying the upper plate of the rigid base portion when the mast is erected, the rigid portion carrying the entire weight of the antenna system and support means, the hinge plate and the upper plate having multiple complementary key means and keyway means spaced about the mast which interengage when the mast is erected to orient the mast precisely with respect to the base with the lower end of the mast engaged in said saddle, the antenna system support means being substantially cylindrical for all cross sections taken normal to the mast;

(c) means connected between the base and the mast for erecting and retracting the mast; and (d) the entire weight of the antenna system and the system support means being divided among said three tripod legs.

2. The tower as set forth in claim 1, wherein said means for erecting and retracting the tower comprises an hydraulic cylinder pivotally connected to the base and having a piston rod coupled with the mast at a point which is below the upper plate and above the lower plate when the mast is erected, and further comprises an hydraulic pressure and control valve circuit for extending or retracting the cylinder and means for locking the cylinder in any desired intermediate position.

3. The tower as set forth in claim 1, further including means for indicating the position of the base with respect to level while the heights of said ground contacting pads are being adjusted.

4. The tower as set forth in claim 1, including a pallet fixed to said rigid base portion at a location spaced from said tripod portion and at a level above the level of the ground contacting pads, stabilizing strut means connected between the pallet and its outer end of the tripod leg, and the pallet being elongated to underlie the mast and antenna system when the mast is retracted and serve as a platform from which servicing of the antenna system is accomplished.

5. The tower as set forth in claim 4, wherein the tower is made mobile for transport thereof by attaching thereto removable wheeled modules, said pallet having fittings shaped to interface with and connect to said wheeled modules, and the said tripod legs being separable from the remainder of the base and storable on the pallet during said transport.

6. The tower as set forth in claim 1, wherein each leg of the tripod portion comprises a three strut truss extending inwardly from a ground contacting pad and being fixed to said rigid base portion and including two diverging upper struts and a lower strut, the struts of the legs being fixed to the rigid base portion in such a way that the axes of adjacent upper struts of different legs mutually intersect in pairs on an imaginary circle drawn horizontally about the center of the mast when erected, and the axes of the lower struts intersect the center of the mast below said imaginary circle.

7. A mobile tower for supporting a radar antenna system including an associated azimuth and elevation drive pedestal, and for selectively moving the antenna system between an erected operational position and a substantially horizontal retracted position, comprising:

(a) a base including a central rigid portion and a tripod portion including legs extending from the rigid portion and having adjustable height ground contacting pads;

(b) a mast connected near its lower end by a horizontal hinge to the rigid portion of the base and pivotable thereabout between said erected and retracted positions, the mast having an upper end supporting said antenna system;

(c) means connected between the base and the mast for erecting and retracting the mast; and (d) azimuth and elevation resolvers on the drive pedestal, a biaxial tilt monitor carried by the mast for indicating tilt of the mast in two orthogonal directions, a twist monitor for determining twist of the mast with respect to the ground, and computer means connected to receive signals from said resolvers and monitors, the computer including display means for displaying azimuth and elevation angles of the antenna corrected for tilt and twist.

8. The tower as set forth in claim 7, wherein said twist monitor comprises potentiometer means fixed to the mast near its lower end, and a monitor tripod placed on the ground independently of the base and beneath the mast and having a member engaging the potentiometer means and operative to move the latter in response to twisting of the mast.

9. The tower as set forth in claim 8, wherein said potentiometer means includes two potentiometers spaced across the bottom of the mast and engaging said member, the potentiometer means being connected to provide a differential output in response to twist of the mast.

10. The tower as set forth in claim 7, wherein said biaxial tilt monitor is mounted on the antenna system in alignment with the axis of rotation of the azimuth drive pedestal so that the tilt monitor rotates with the antenna.

11. A mobile tower for supporting a radar antenna system including an associated azimuth and elevation drive pedestal, and for selectively moving the antenna system between an erected operational position and a substantially horizontal retracted position, comprising:

(a) a base including a central rigid portion and a tripod portion including legs extending from the rigid portion and having adjustable height ground contacting pads;

(b) a mast connected near its lower end by a horizontal hinge to the rigid portion of the base and pivotable thereabout between said erected and retracted positions, the mast having an upper end supporting said antenna system;

(c) means connected between the base and the mast for erecting and retracting the mast;

(d) said mast comprising multiple cylindrical telescoping mast sections, the sections being joined together for mutual telescoping between shortened and extended positions by guidance roller and track means fixed to the mast sections, and the mast sections respectively having annular rings attached thereto including bolting flanges placed on the mast sections so that the flanges of adjacent mast sections are in mutual alignment and abut each other when the mast sections are telescoped into either shortened or elongated positions, whereby selected bolting flanges can be bolted together to lock the mast sections telescoped together in shortened positions to occupy a minimal space or bolted together in other positions to provide a mast of changeable height.

12. The tower as set forth in claim 11, wherein the mast includes an intermediate section having track means on its inside and outside surfaces, and includes other sections respectively telescoping inside of and outside of said intermediate section, said other sections having openings in their side walls opposite said track means and having roller means journaled in housings which are secured to the side walls at said openings.

* * * * *